United States Patent [19]

Mertes et al.

[11] 4,244,546

[45] Jan. 13, 1981

[54] UNIVERSAL DRAWER GUIDE MOUNTING BRACKET

[76] Inventors: Paul Mertes, 15528 Don Metz St., Mission Hills, Calif. 91345; Gary W. Nelson, 22933 Hatteras St., Woodland Hills, Calif. 91367

[21] Appl. No.: 21,970

[22] Filed: Mar. 19, 1979

[51] Int. Cl.[3] ..... A47B 88/00

[52] U.S. Cl. ..... 248/258; 248/271; 248/298; 312/343

[58] Field of Search ..... 312/330, 342–349; 308/3.6, 3.8; 248/223, 251, 258, 259, 265, 270, 271, 298

[56] References Cited

U.S. PATENT DOCUMENTS

| | | | |
|---|---|---|---|
| 3,352,617 | 11/1967 | Daigene | 312/343 |
| 3,675,883 | 7/1972 | Holmes | 312/343 |
| 3,750,993 | 8/1973 | Read | 312/343 X |
| 3,981,553 | 9/1976 | Gutner | 312/342 |

*Primary Examiner*—Casmir A. Nunberg
*Attorney, Agent, or Firm*—Poms, Smith, Lande & Rose

[57] ABSTRACT

A rear mounting bracket or mount for center guide type drawer guides is universally adjustable relative to the cabinet in which it is mounted. A base attaches one side of the mounting bracket to a mounting surface. A drawer guide attaching member connects the other side of the mounting bracket to a furniture-type drawer guide. An adjusting structure forms the interface between the base and guide attaching member and allows positional adjustment of the drawer guide. The structure includes friction-creating ribs which resist movement between the base and the guide attaching member. The use of an external force is consequently required to move the guide attaching member relative to the base. Once the correct position of the guide attaching member has been established, the adjusting structure increases the resistance to adjustment of the rear end of the drawer guide. Depending on its configuration, the adjusting structure can allow both horizontal and vertical, or just horizontal movement of the guide attaching member relative to the base. The adjusting structure includes a partially open channel formed on the base, through which a sliding foot attached to the guide attaching member moves. The channel can be replaced by a cross-ribbed area on the base along with means for forcing the sliding foot against the base.

24 Claims, 11 Drawing Figures

Fig. 1.
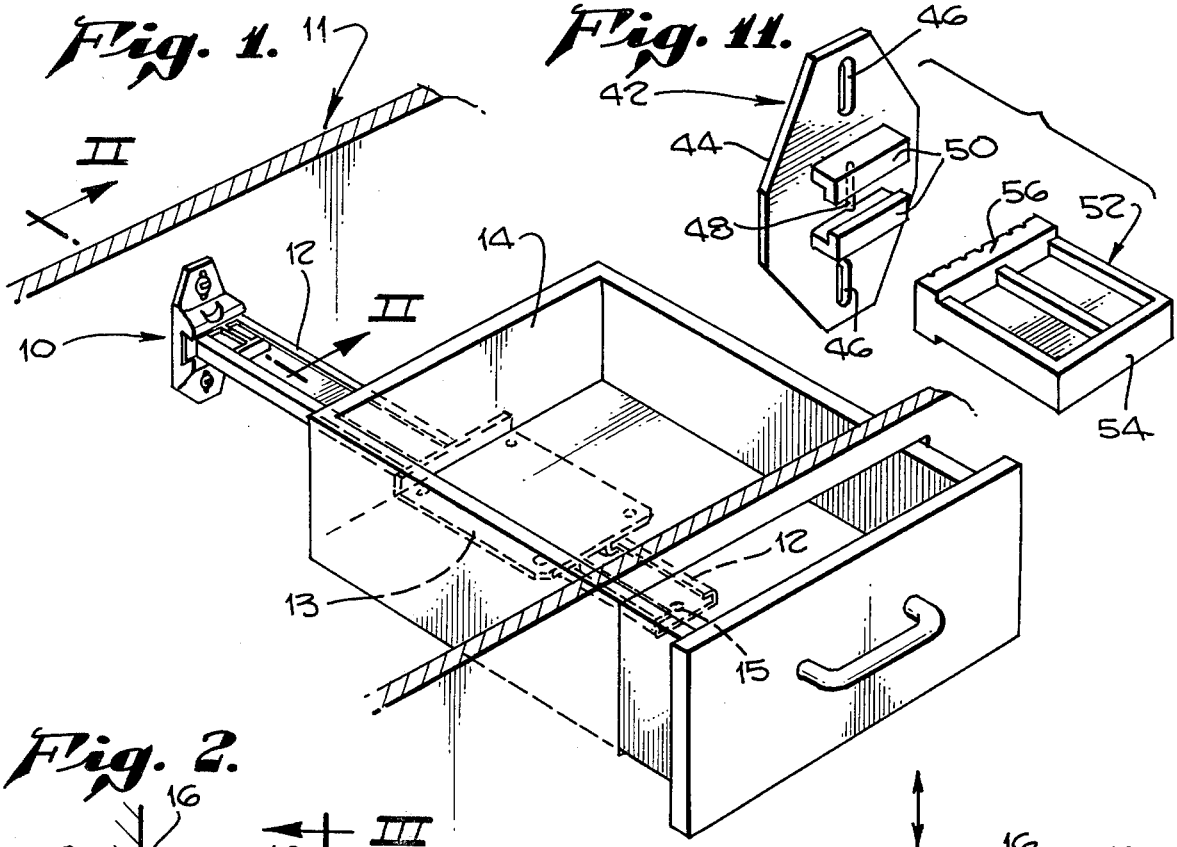
Fig. 11.
Fig. 2.
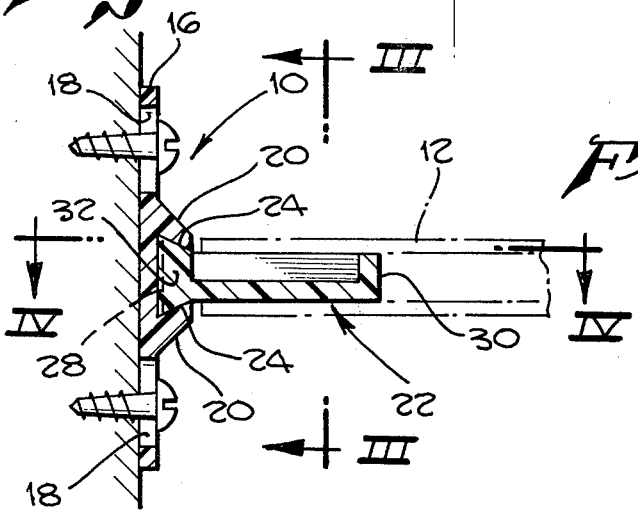
Fig. 3.
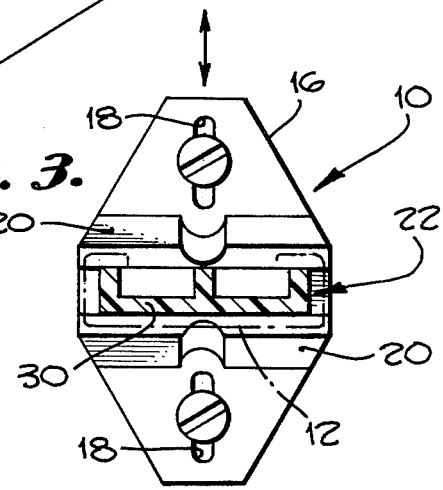
Fig. 4.
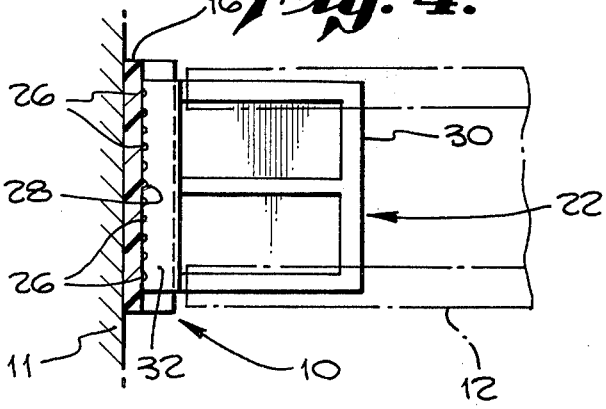
Fig. 5.
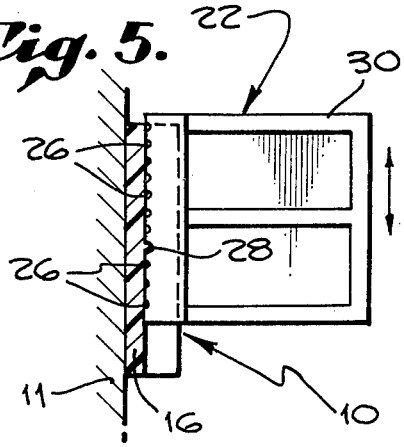

Fig. 6.
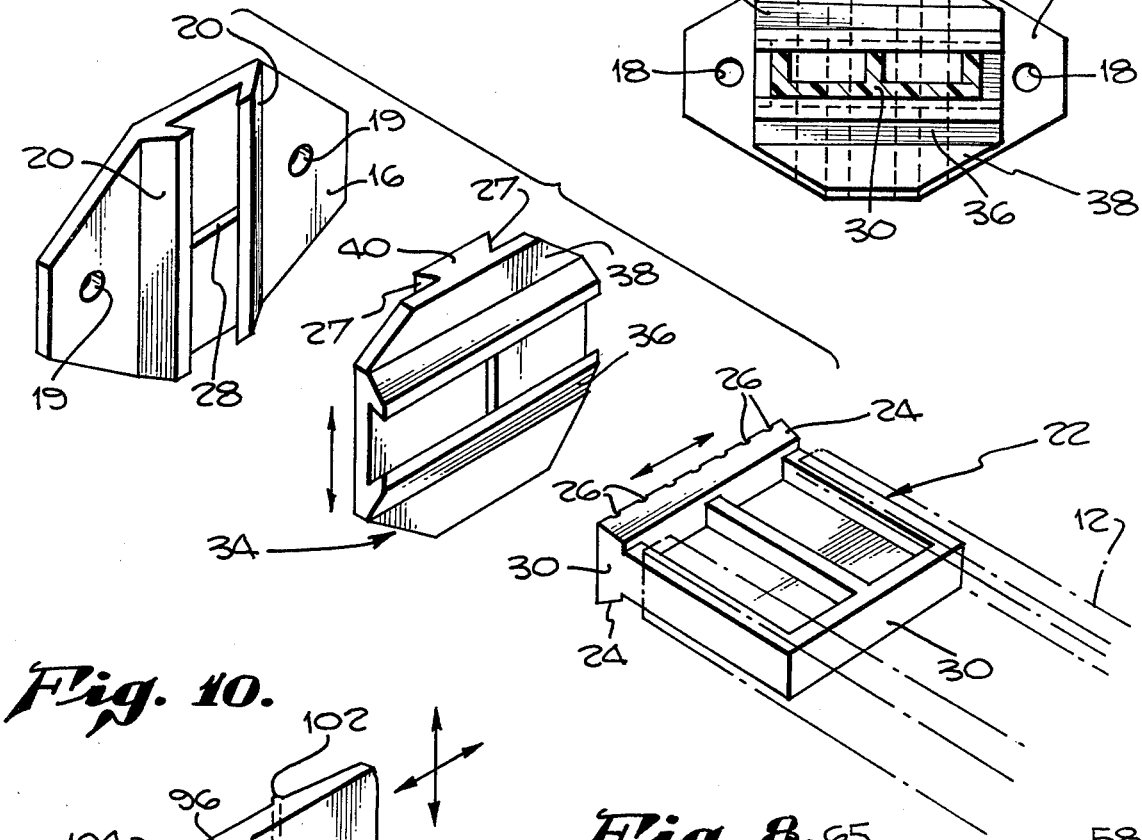
Fig. 7.
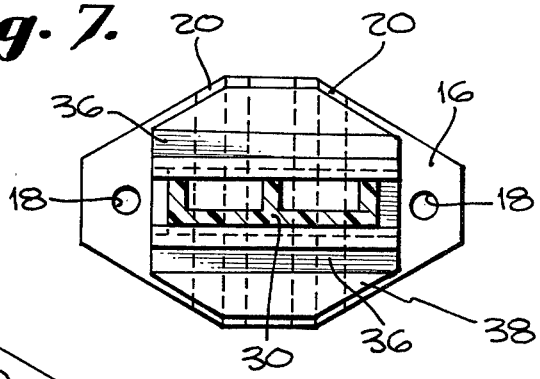
Fig. 10.
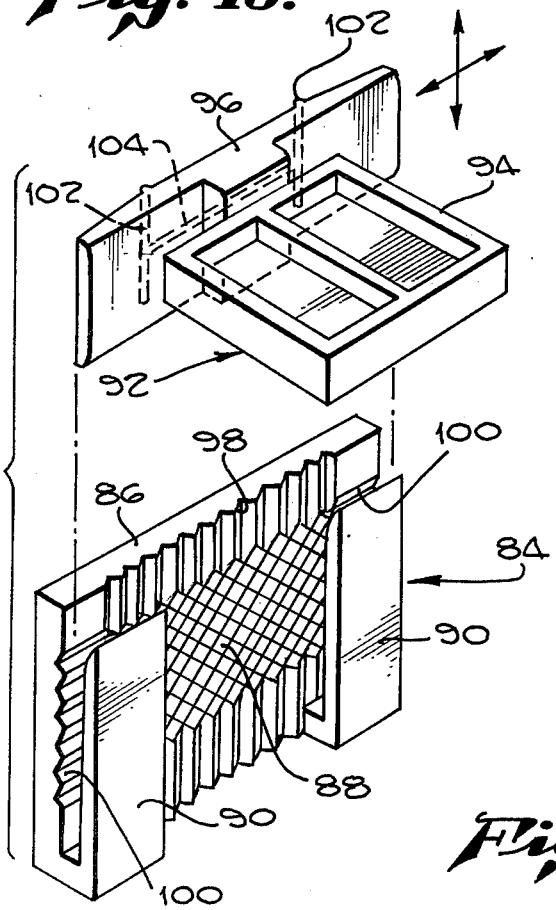
Fig. 8.
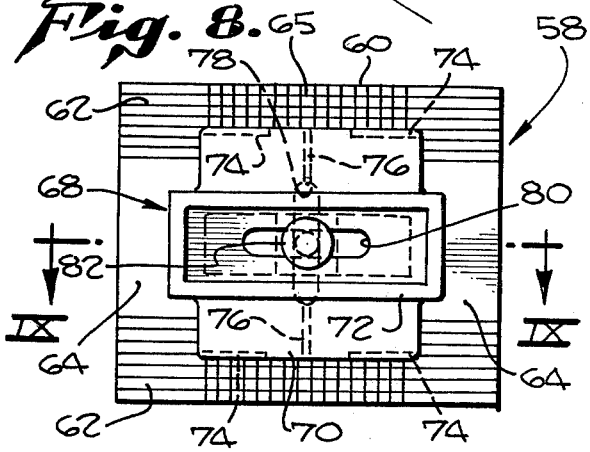
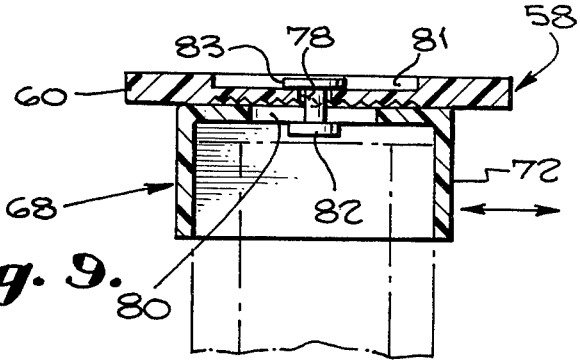
Fig. 9.

UNIVERSAL DRAWER GUIDE MOUNTING BRACKET

FIELD OF THE INVENTION

The present invention relates to adjustable drawer guide mounting brackets, and more particularly to rear mounting brackets for certain guide type drawer guides.

BACKGROUND OF THE INVENTION

The mounting and adjustment of a drawer in a cabinet or other item of furniture has typically been a time-consuming process. Drawers are usually mounted in cabinets using a centrally located drawer guide extending from the drawer opening in the front of the cabinet to a mounting surface at the rear of the cabinet. Into the mounted drawer guide fits a sliding member attached to the drawer itself. One of the most common types of drawer guide is referred to as the center-guide type drawer guide. In this type of drawer guide, a single guide is positioned longitudinally beneath the center of the drawer and orients and aligns the drawer as it is slid in and out of the cabinet.

The center-guide type of drawer guide is typically mounted in a cabinet by first securing to the cabinet the end of the guide closest to the drawer opening. The rear of the guide is then mounted, by means of a bracket, to the rear wall of the cabinet. The mounting bracket most commonly used has horizontal and vertical screw slots to adjust the position of the bracket once mounted on the cabinet. With this bracket, the screws used with the slots have to be alternately inserted and removed in the vertical and horizontal slots as the bracket is adjusted to square the drawer front with the opening in the cabinet face. Additionally, the horizontal and vertical adjustments provided by the slots are relatively small. The critical adjustment with a drawer guide is in the horizontal direction, as it is this adjustment which prevents the drawer from binding in the cabinet. The vertical adjustment is not as critical as it only determines the angle of the drawer relative to the cabinet and does not usually affect the binding. Because of the limited adjustment, if the initial placement of the bracket is too far out of line, the bracket may have to be completely removed and repositioned. Therefore, the adjustment of a drawer guide mounted with this type of bracket consumes much time and labor and needlessly slows down the construction of the cabinet. Furthermore, these brackets often have to be readjusted when the cabinets are transported or jarred, because such actions can cause the drawer to become out of square with the cabinet face. This readjustment requires repetition of the inefficient process described above.

A further problem with this type of bracket is that the drawer guide mounts rigidly in one location on the bracket. Consequently, small production variations in the length of the guide or the depth of the cabinet require special fitting of the mounting bracket to the drawer guide and to the cabinet. These special adjustments further exacerbate the problems caused by the basic inefficiency of the mounting bracket itself.

A final problem with the mounting brackets found in the prior art are that the vast majority of them are designed to be mounted by screws or nails to the cabinets. The installation of the drawer guides in cabinets can be accomplished much more quickly if the mounting brackets are designed so that they can be stapled into the furniture cabinet.

Accordingly, it is the principal object of this invention to provide for the rapid adjustment of a drawer guide mounted in a furniture-type cabinet without the necessity of moving the location of the mounting bracket once it is secured to the cabinet.

It is a further object of this invention to eliminate special fitting of the drawer guide to the mounting bracket and of the bracket to the cabinet when production variations occur in the depth of the cabinet or the length of the drawer slide.

It is a final object of this invention to allow adjustable drawer guide mounting brackets to be quickly affixed, by staples or similar devices, to furniture cabinets.

SUMMARY OF THE INVENTION

The present invention, in a broad aspect, provides a drawer guide mounting bracket allowing, with respect to surface to which the mount is attached, universal adjustment of a drawer guide attached to the mounting bracket, without removing or relocating the bracket fastners. The mounting bracket includes a base for attaching one side of the bracket to a mounting surface. A guide attaching member connects one end of a furniture-type drawer guide to the other side of the bracket. Forming the interface between the guide attaching member and the base is an adjusting structure which allows displacement of the guide attaching member relative to the base, thereby providing positional adjustment of the drawer guide.

In accordance with one feature of the invention, the base is a substantially flat member and includes passages for passing screws or other fastening devices through the base to a mounting surface. Also, the guide attaching member can be either a tongue member adapted to be positioned within the open end of a furniture-type drawer guide having a C-shaped cross-section, or can be a socket member adapted to be positioned over the end of such a drawer guide.

In accordance with another feature of the invention, the adjusting structure includes a partially open channel formed on the base. Two arm members extend laterally across the base and project toward each other in a manner forming, along with the surface of the base, an open channel having a cross-section which decreases with distance from the base. The channel which results is trapezoidal in cross-section, the cross-sectional shape being generally referred to as a dovetail. Into this channel is positioned a sliding foot having a cross-section similar to that of the channel. The sliding foot can be integrally formed on the guide attaching member. The shape of the channel allows the sliding foot to be moved through the channel. The shape of the channel also exerts a force against the sliding foot which resists movement between it and the base when the base is affixed to a mounting surface.

In accordance with one aspect of the invention, irregular, friction-producing surfaces are present across the bottom of the channel and across the bottom of the sliding foot. This may take the form of a ridge on one surface and a series of mating ribs or ridges on the other surface. For specific example, the channel may be provided with a transverse rib, and the bottom of the foot with a series of transverse ridges or ribs. Using this construction, the ribs on the sliding foot would engage the ridge in the channel, and the resulting friction aids the shape of the channel in resisting movement of the sliding foot. Consequently, an external force is generally required to be applied to the guide attaching member in order to move it and its sliding foot relative to the base. The friction between the ridge and the ribs also locks the position of the sliding foot, and therefore that of the guide attaching member, once the correct position of the sliding foot has been established. In this embodiment of the adjusting structure, the vertical adjustment of the drawer guide relative to the mounting surface may be provided by the passages or slots in the base, and the horizontal adjustment is provided by moving the sliding foot in the channel formed on the base.

In accordance with still another feature of the invention, the adjusting structure can also include an adaptor plate, which is positioned between the sliding foot on the guide attaching member and the open channel on the base, to allow both horizontal and vertical movement of the guide attaching member relative to the base. The adaptor plate comprises a substantially flat plate member, on which one side is formed a sliding foot identical in design to that formed on the guide attaching member. Across the bottom of the sliding foot are a series of ribs which engage the ridge in the open channel. These ribs perform the same functions as those on the underside of the sliding foot portion of the guide attaching member. On the other side of the plate member is a partially open channel identical in design to the channel formed on the base. This channel is oriented perpendicular to the sliding foot on the opposing side of the plate member. Into this open channel is positioned the sliding foot portion of the guide attaching member. The channel includes a ridge across its mid-section which performs the same function as the ridge in the channel formed on the base.

The use of the adaptor plate allows the guide attaching member to be adjusted in vertical and horizontal directions relative to the base. When the adaptor plate is utilized with the base, the base slots are positioned in a horizontal orientation. Accordingly, the horizontal adjustment of the guide attaching member relative to the base is made by moving the sliding foot portion of the guide attaching member in the open channel on the upper side of the direction enabling member. Similarly, the vertical adjustment of the guide attaching member is made by moving the sliding foot on the underside of the adaptor plate in the open channel on the base. The use of the adaptor plate member allows a much wider adjustment in the vertical direction than do the base slots alone.

In accordance with still another feature of the invention, the open channels formed on the base and on the direction enabling member may be formed to have, in cross-section, the shape of an inverted "T". When the open channels have this shape, the sliding foot portions of the guide attaching member and the adaptor plate also have the same shape in cross-section. The operation of the guide mount would be identical to that discussed above. Likewise, various other channel shapes could also be utilized to practice the present invention.

In accordance with a further feature of the invention, the adjusting structure could utilize, instead of the partially open channels, a series of intersecting ribs extending laterally and longitudinally along the surface of the base. The sliding foot portion of the guide attaching member would then have, instead of a series of ribs disposed laterally across its underside, several ribs extending longitudinally and several ribs extending transversely across its underside. These ribs would be positioned between the ribs on the surface of the base. The adjusting structure would also include members to force the sliding foot against the base, such as overhanging arm members, thereby creating a friction force resisting movement of the sliding foot relative to the base until an external force greater than the friction force is applied to the sliding foot. This frictional force would prevent movement of the sliding foot relative to the base after the external force is removed.

In accordance with still another feature of the invention, the overhanging arm members described above could be eliminated and the sliding foot could be forced against the ridges on the base by a pin or similar member passing through a slot provided in the sliding foot and a slot provided in the base. These slots would be of a dimension so as to allow the desired horizontal and vertical movement of the sliding foot relative to the base. The slot in the sliding foot would be disposed perpendicular to the slot in the base, thereby allowing the two-dimensional adjustability. As before, the forcing of the sliding foot against the base ridges by the pin would mandate the use of an external force to move the sliding foot and would lock the sliding foot against the base when the external force has been removed.

Arrangements may also be provided for increasing the frictional engagement of the base member relative to the movable guide holder; for example, in the simpler structure using a rib on the base and ridges on the sliding feet, such additional frictional engagement may be obtained by firmly securing the base to the cabinet, by additional staples, or by tightening screws, thereby reducing the flexibility of the base.

In accordance with a final feature of the invention, the drawer guide mount can be constructed of an easily-formable material such as high density polyethylene. Also, the drawer guide mount is designed for use with drawer guides constructed of various materials, such as steel or plastic.

Other objects, features, and advantages of the present invention will become apparent from a consideration of the following detailed description and from the accompanying drawings.

BRIEF DESCRIPTION OF THE DRAWINGS

FIG. 1 shows a universal drawer guide mounting bracket illustrating the principles of the present invention and installed in a furniture cabinet utilizing a center-guide type drawer guide;

FIG. 2 is a side view of an exemplary embodiment of a universal drawer guide mounting bracket constructed according to the present invention;

FIG. 3 is a plan view of the drawer guide mounting bracket shown in FIG. 2 taken along plane III—III;

FIG. 4 is a sectional view of the adjusting portion of the drawer guide mounting bracket shown in FIG. 2 taken along plane IV—IV;

FIG. 5 shows the movement of the adjusting member relative to the base member for the guide mounting bracket shown in FIG. 4;

FIG. 6 is a exploded perspective view of an alternative embodiment of the guide mounting bracket shown in FIG. 1;

FIG. 7 is a plan view of the drawer guide mounting bracket shown in FIG. 6;

FIG. 8 is a plan view of another alternative guide mounting bracket illustrating the principles of the invention;

FIG. 9 is a sectional view of the guide mounting bracket shown in FIG. 8, taken along plane IX—IX;

FIG. 10 is an exploded perspective view of another alternative embodiment of the guide mounting bracket; and FIG. 11 is a side view of still another alternative embodiment of the invention.

DETAILED DESCRIPTION

Referring more particularly to the drawings, FIG. 1 shows the installation of a universal drawer guide mounting bracket 10 in a furniture cabinet 11 employing a center-guide type drawer guide system. In this system, a non-moving, C-shaped guide member 12 is attached to the cabinet 11 beneath the area in which the cabinet drawer 14 slides. The guide 12 may for example be a steel channel. The fixed guide member 12 is attached to the cabinet 11 by a screw 15 at one end and by the universal drawer guide mounting bracket 10 at the other end. Attached to the drawer 14 is a moving slide member 13 designed to fit within the confines of the fixed guide member 12.

The mounting bracket 10 fastens the fixed guide member 12 to the cabinet 11 in a manner which allows the rear portion of the guide member 12 to be adjusted vertically or horizontally with respect to the location on the cabinet 11 at which the mounting bracket 10 is attached.

As mentioned, attachment of the fixed portion of a drawer guide to a cabinet has usually been done through a mounting bracket having only horizontal and vertical slots as the means by which the bracket was adjusted. The screws used with the horizontal and vertical slots have to be alternately inserted and removed in either the vertical and horizontal slots as the bracket is adjusted to square the drawer front with the opening in the cabinet face.

By contrast, the mounting bracket 10 shown in FIG. 1 allows adjustment of the rear portion of a drawer guide affixed to a furniture cabinet without the necessity of removing the mounting screws. The mounting bracket 10 provides a limited adjustment in the vertical direction and a wide adjustment in the horizontal direction. Consequently, the alternate insertion and removal of screws in the horizontal and vertical slots of the brackets found in the prior art is no longer necessary.

Referring to FIGS. 2 through 5, it is seen that the mounting bracket 10 comprises a base member 16, a guide attaching member 22, and an adjusting structure comprising an open channel formed on the base and a sliding foot 32 formed on the guide attaching member.

The base member 16 is constructed of a substantially flat piece of material such as plastic or metal. Two slots 18 are formed in the base member 16. These slots 18 are oriented vertically when the bracket 10 is attached to a surface and are the means by which vertical adjustment of the bracket is made. As is shown most clearly in FIG. 2, the base member 16 has two projections 20 extending transversely across its surface. These projections 20 can be integrally formed within the base member 16 and are upwardly sloped toward each other. The upward sloping of the projections 20 forms, along with the base 16, a partially open channel having a cross section which is trapezoidal in shape, the shape being commonly referred to as a dovetail. Extending laterally across this dovetail-shaped channel is a single ridge 28. The ridge 28 can also be integrally formed in the base 16.

The guide attaching member 22 comprises a rectangularly-shaped tongue member 30 to which is attached a dovetail-shaped sliding foot 32. The tongue member 30 is of a size as to fit into the end of a C-shaped drawer slide. The sliding foot 32 has two sloping side walls 24 which fit beneath the projections 20 from the base 16. As shown in FIG. 4, on the bottom of the foot 32 are a plurality of ribs 26. These ribs are of the same shape as the ridge 28 at the bottom of the open channel on the base 16.

The sliding foot 32 is designed to fit between the projections 20 from the base 16. The ribs 26 on the bottom of the foot 32 contact the ridge 28 on the base 16 as the sliding foot 32 is fitted between the upward projections 20. The contact of the ribs 26 in the foot 32 with the ridge 28 in the base 16 creates friction between the base 16 and the guide attaching member 22. This friction resists movement of the guide attaching member 22 within the base 16. Additionally, the projections 20 are designed so as to exert force upon the side walls 24 of the sliding foot 32 as the base 16 is screwed or fastened to a cabinet through the slots 18. Thus, the combination of the friction-creating ribs 26 and ridge 28 and the force of the projections 20 on the foot side walls 24 causes the base 16 to resist movement of the sliding foot 32 to the extent that the guide attaching member 22 must be tapped with a hammer or have firm manual pressure applied to it in order to move it relative to the base 16. This characteristic ensures that once an adjustment is made, subsequent vibration and racking of the cabinet is not likely to cause the sliding foot 32 to slip within the confines of the base projections 20. FIGS. 4 and 5 show the movement of the guide attaching member 22 relative to the base member 16 which occurs as the adjustment of the drawer guide is made.

When the bracket 10 is used to mount the rear end of the fixed guide portion of a center-guide type drawer guide, the vertical positioning is done by moving the base slots 18 relative to the screws or other fastening devices passing through them. A preliminary horizontal adjustment may also be made prior to firmly tightening the screws. The screws are then firmly secured. The final horizontal adjustment is then made by tapping or forcing the guide attaching member 22 to move relative to the base member 16. If subsequent racking or vibration causes the drawer to become out of square with the cabinet face, a slight tapping on the guide attaching member 22 can re-square the drawer relative to the cabinet and prevent the binding which would otherwise occur.

In a working model of the invention, the guide mount 10 was constructed of high-density polyethylene. The vertical dimension of the base 16 was approximately $2\frac{1}{2}$ inches and the horizontal dimension, which is also the length of the dovetail-shaped channel, was approximately $1\frac{3}{4}$ inches. The slots 18 were approximately $\frac{1}{2}$ inch in length. The ridge 28 in the base 16 and the ribs 26 along the bottom of the sliding foot portion 32 of the guide attaching member 22 were all approximately $\frac{1}{8}$ inch in height, thereby providing horizontal adjustment of the guide relative to the bracket 10 in $\frac{1}{8}$ inch increments. The rectangular tongue 30 portion of the guide attaching member 22 was approximately $1\frac{1}{4}$ inches in width and $\frac{1}{4}$ inch in height. These dimensions allowed the tongue member 32 to be used with the types of C-shaped drawer guides most commonly found and gave a vertical adjustment of $\frac{1}{2}$ inch and a horizontal adjustment of one inch.

One characteristic of the invention is that the use of the tongue member 30 allows the channel guide used with the bracket 10 to be shorter than the recommended length and yet still be held firmly to the cabinet and function properly, since the length of the tongue member 30 compensates for the length of the slide. This feature also provides an increased tolerance for production variations in the depth of the cabinet as the fixed portion of the drawer guide can be set to any position on the tongue member 30 providing sufficient overlap for adequate rigidity.

As is shown most clearly in FIG. 8, the tongue member 30 may be replaced by a socket member 72. This socket 72 would fit over, instead of within, the end of a C-shaped drawer guide. The depth of the socket 72 could be the same as the length of the tongue member 30, thereby providing the same advantages with respect to the length of the guide and the depth of the cabinet as does the tongue member 30.

FIGS. 6 and 7 show an alternative embodiment of the bracket 10 shown in FIGS. 2 through 5, using three parts instead of two. In FIG. 6, the adjusting structure has been expanded to include an adaptor plate 34 positioned between the base 16 and the guide attaching member 22 to allow the guide attaching member 22 to move in both horizontal and vertical directions, without shifting the position of the base 16. The adaptor 34 comprises a flat plate 38, having molded on the side closest to the guide attaching member 22 two projections 36 having the same dimension and orientation as the projections 20 on the base 16. These projections form a partially-open channel on the adaptor 34. On the side closest to the base 16 is molded a sliding foot 40 having the same dimension as the sliding foot 32 portion of the guide attaching member 22. The foot 40 of the adaptor 34 is positioned within the dovetail-shaped channel formed by the projections 20 on the base 16. The sliding foot 32 portion of the guide attaching member 22 is positioned within the dovetail-shaped open channel formed by the projections 36 from the adaptor 34. Similar ribbing 27 is used in the adaptor 34 to that utilized in the base 16 and in the guide attaching member 22.

When the adaptor 34 is used along with the guide mounting bracket shown in FIGS. 2 through 5, screw holes 19 are used instead of slots. These holes 19 are positioned in a horizontal, instead of vertical, orientation. This orientation is necessary to keep the tongue member 30 projecting in a horizontal orientation, so as to accept the end of the drawer guide. The adaptor plate 34 allows the guide attaching member 22 to be moved over a wide range of horizontal and vertical positions. This wide range of adjustment allows the base 16 to be affixed to its mounting surface with a minimal amount of adjustment. Any positional adjustment of the drawer guide would be done with the guide attaching member 22 and the adaptor 34.

In the working model of the adaptor plate 34 used with the working model of the guide mounting bracket described above, the projections 36 from the upper surface of the adaptor plate 34 were of the same design as the projections 20 from the base 16 and the foot 40 was of the same design as the foot 32 on the guide attaching member 22. The adaptor plate 34 was constructed of the same material as the bracket 10. The adaptor plate 34 allowed horizontal and vertical adjustments of approximately one inch to be made to the guide attaching member 22 relative to the base 16.

FIG. 11 shows another alternative embodiment of the drawer guide mounting bracket 10 depicted in FIGS. 2 through 5. In this embodiment, the dovetail-shaped open channel has been replaced by a T-shaped channel. In FIG. 11, a base 44 contains slots 46 and a ridge 48 identical in function and design to the corresponding elements of FIGS. 2 through 5. The base 44, however, has two L-shaped projections 50 extending vertically upward from it. The projections 50 extend laterally across only a portion of the base 44. The projections 50 serve the same function as the corresponding projections 20 in the base 16 shown in FIGS. 2 through 5; that is, they retain the sliding foot portion of a guide attaching member inserted therebetween. The guide attaching member 52, as shown in FIG. 11, has a tongue member 54 similar to the tongue member 30 shown in FIG. 2. To this tongue member 54 is attached a foot 56. The foot 56 has a shape corresponding to that of the inner portion of the open channel formed by the L-shaped members 50. Additionally, the foot 56 has a plurality of ribs extending laterally across it which engage the single ridge 48 on the base 44. The ribbing creates the friction which resists movement of the guide attaching member 52 relative to the base 44. The alternative embodiment shown in FIG. 11 could also utilize a socket member, as depicted in FIG. 8, as opposed to the tongue member 54 depicted.

The operation of this embodiment shown in FIG. 11 is the same as that of the embodiment shown in FIGS. 2 through 5. That is, the screw slots 46 provide the vertical adjustment for the bracket. The horizontal adjustment is made with the guide attaching 52.

An adaptor plate similar to the adaptor plate 34 shown in FIGS. 6 and 7 may be used with the apparatus shown in FIG. 11 to allow both horizontal and vertical movement of the guide attaching member relative to the base. Such an adaptor could comprise a plate having a channel similar to that on the base located on the side of the plate closest to the guide attaching member, and a foot similar to that on the guide attaching member 52 located on the side closest to the base. The previous principles of operation of such an adaptor plate would apply.

FIGS. 8 and 9 show still another alternative embodiment of the present invention. FIGS. 8 and 9 show a universal guide mounting bracket 58 which is adapted to be stapled into a piece of furniture such as a cabinet. The bracket 58 provides a wide range of horizontal and vertical adjustment for a center guide-type drawer guide connected to it. Referring specifically to FIG. 8, the bracket 58 comprises, as before, a base member 60, a guide attaching member 68, and an adjusting structure.

The base member 60 is formed of a substantially flat plate of material. The guide attaching member 68 comprises a rectangularly shaped socket member 72 which is adapted to fit over the end of a C-shaped furniture guide.

The adjusting structure comprises a slot 78 in the base member 60, a slot 80 in the guide attaching member 68, a cross-ribbed grid area 65 on the base, locking flanges 70 on the guide attaching member 68, and a guide pin 82.

More specifically, the base slot 78 passes completely through the base and is oriented vertically when the bracket 58 is stapled into a cabinet. The grid area 65 extends across the center of the base 60. This grid 65 comprises a series of intersecting grooves cut longitudinally and laterally into the base 60, with each groove extending completely across the base. Along each longitudinal edge of the base 60 is a rectangular area 64 which has not been cut with grooves and two areas 62 which only have been grooved in a lateral orientation. The ungrooved portion 64 along each side of the base are the areas into which staples or other fastening devices are driven to attach the bracket 58 to a cabinet or other article of furniture.

The locking flanges 70 are located along each bottom longitudinal edge of the socket 72 portion of the guide attaching member 68. The locking flanges 70 can be integrally formed with the socket 72. On the underside of each locking flange 70 are a plurality of lateral ridges 74 and a pair of longitudinal ridges 76. These ridges 74 and 76 are positioned within the base grid grooves 65.

The slot 80 in the guide attaching member 68 extends through the bottom of the socket member 72. The slot 80 is positioned on the grid 65 in an orientation perpendicular to the grid slot 78. The guide pin 82 passes through the slot 80 in the socket member 72 and through the slot 78 in the base 60. The end of the pin or rivet 82 passing beneath the base 60 may be secured by the use of a washer, and by peening over the end of rivet 82 to secure the washer in place, as shown at 83. The base 60 has a recess 81 for allowing the enlarged end 83 of the pin or rivet 82 to travel beneath the slot 78 in the base 60 without striking the surface to which the bracket 58 is attached.

The positioning of the guide attaching member 68 on the base 60 orients the lateral ribs 74 and the longitudinal ribs 76 on the locking flange 70 within the base grid grooves 65. The fastening of the rivet or pin 82 at 83 is done in a manner which tightly forces the lateral and longitudinal ribs 74 and 76 of the guide attaching member 68 into the grooves in the grid portion 65 of the base 60. This arrangement results in the use of an external force being required to move the guide attaching member 68 to a different position on the grid 65.

As stated, the bracket 58 is designed to be affixed to a piece of furniture or cabinet by means of staples or other fastening devices passing through the unscored areas 64 along the lateral side of the base 60. Once the bracket 58 has been installed on a piece of furniture, the guide attaching member 68 can be moved horizontally and vertically relative to the base 60 to make the proper adjustment to the guide. This particular version of a drawer guide mounting bracket is particularly attractive for high-volume use as it allows for quick installation of the bracket 58 to the furniture and of the guide to the bracket 58.

As is the case with the other embodiments, a working model of the bracket 58 shown in FIGS. 8 and 9 was constructed of high-density polyethylene. The base 60 was made approximately 2 inches square and the slots 78 and 80 in the base 60 and guide attaching member 68 were made approximately $\frac{3}{4}$ inch in length. The gridded area 65 on the base 60 utilized intersecting grooves cut parallel to the sides of the base, and with each of the two surfaces making up each groove being oriented at approximately a 45 degree angle to the plane of the base 60. The grooves were spaced by approximately 3/32 inch to $\frac{1}{8}$ inch apart. This configuration gave a vertical and horizontal adjustment of approximately one inch in approximately $\frac{1}{8}$ inch increments.

The engagement of the ribs 74 and 76 with the grooves in the base serves to resist rotation of the guide attaching member 68 relative to the base 60 as the guide attaching member 68 is moved transversely or longitudinally with respect to the base 60; and this resistance may be enhanced by the engagement of the ribs 74 with the area 62 having grooves running only in one direction.

As before, the socket 72 on the guide attaching member 68 can be replaced by a tongue member Similar to that shown in FIG. 2. This provision allows differing types of C-shaped drawer slides to be utilized with the bracket 58.

FIG. 10 shows still another alternative embodiment of the present invention. FIG. 10 shows an exploded perspective view of a universal guide mounting bracket 84. The bracket 84 comprises a base 86, a guide attaching member 92, and an adjusting structure. In this embodiment, the adjusting structure comprises a sliding foot 96 on the guide attaching member along with its accompanying ribs 102 and 104, a gridded area 88 on the base 86, and a pair of arms 90 for forcing the guide attaching member 92 against the base 86.

More specifically, the gridded area 88 on the base 86 is formed with a series of crosscut grooves. These grooves are similar in concept and implementation to the cross-ribbed section 65 of the mount 58 previously discussed. Additionally, the base 86 has an area 98 running along its bottom longitudinal edge which has grooves oriented solely in a lateral direction and an area along each lateral edge containing an area 100 which has grooves running solely in a longitudinal direction.

Cantilevered over the base 86 are the pair of locking arms 90. These locking arms 90 can be either integrally formed with the base 86 or separately formed and attached to the base 86 by gluing, stapling, etc. These arms are positioned over the longitudinally-scored areas 100. These locking arms 90 hold the guide attaching member 92 firmly against the base 86, thereby resisting movement of the guide attaching member 92 relative to the base 86.

The guide attaching member 92 comprises a tongue member 94 adapted to be inserted into the end of a C-shaped drawer guide. As before, this tongue member 94 could be replaced with a socket-type member adapted to enclose one end of a C-shaped drawer guide. Attached to the tongue member 94 is the sliding foot 96. The sliding foot is of approximately the same length as the base 86. The ends of the sliding foot 96 are tapered and are oriented beneath the locking arms 90 in a manner in which the locking arms 90 firmly press the ends of the foot 96 against base 86. Along the underside of the foot 96 are the two lateral ridges 102 and the one transverse ridge 104. These ridges are pressed into the cross-ribbed area 86 on the base by the locking arms 90 and, along with the locking arms 90, create a frictional force as well as a camming or vector force which resists movement between the foot 96 and the base 86. Resiliency is provided by the arms 90 and the tapered ends of the foot 96.

The bracket 84 is adapted to be attached to a cabinet or item of furniture by means of staples or other fastening devices driven into the unidirectionally-scored areas such as 98 along the longitudinal and lateral edges of the base 86. Once the mount 84 is attached, easy adjustment of the position of the guide attaching member 92 may be made by tapping it with a hammer or by applying firm manual force to it. This ease of adjustability of the device makes it attractive for high-volume drawer production applications where speed of aligning the drawers in the cabinets is of prime importance.

In a working model constructed of this embodiment, a base member approximately 3 inches in length and $1\frac{1}{4}$ inches in width was utilized. The ribbing was of the same design as that in the embodiments previously discussed. This arrangement of the foot 96 and the base 86 allowed an adjustment in the vertical direction of approximately $\frac{3}{4}$ inch and in the horizontal direction of approximately $1\frac{1}{2}$ inches. This embodiment of the apparatus allows a wider range of adjustment than do other embodiments.

In an unillustrated alternative version of the embodiment discussed above, the locking arms 90 can be made to completely enclose the end of the base 86. While this arrangement makes it slightly more difficult to assemble the foot 96 onto the base, the foot 96 is held with more force to the base 86 than is the case with the open arms 90.

In the foregoing description of the present invention, a preferred embodiment and several alternative embodiments of the invention have been disclosed. It is to be understood that other mechanical and design variations are within the scope of the present invention. Thus, by way of example and not of limitation, different materials could be utilized to form the various components of the guide mounting bracket; a slightly different style or positioning of the grooves and ribbing could be utilized; the open channel in the preferred embodiment could be rounded or take other shapes than that described; and the dovetail opening, for example, could be formed on the guide attaching means, rather than on the base. Accordingly, the invention is not limited to the particular arrangements which have been illustrated and described in detail.

What is claimed is:

1. A universal rear drawer guide mounting bracket, for easy use in inaccessible locations, comprising:

base means for attaching one side of said mounting bracket to a mounting surface;

drawer guide attaching means for connecting one end of a furniture-type drawer guide to the other side of said mounting bracket;

adjusting means, forming the interface between said base and said drawer guide attaching means, for allowing displacement of said drawer guide attaching means relative to said base means, thereby providing positional adjustment of a drawer guide mounted to said drawer guide attaching means, said adjusting means including locking means for resisting movement between said drawer guide attaching means and said base means once the proper position for said drawer guide has been established; and means forming part of said base means and said drawer guide attaching means, for resiliently urging said adjusting means into locking action, independent of any structure to which said base means may be attached;

whereby said mounting bracket may be easily positioned, in inaccessible locations such as inside the rear of a cabinet by centrally locating said attaching means relative to said base means, securing a drawer guide onto said drawer guide attaching means, locating said bracket in position while holding said drawer guide, securing said mounting bracket to a mounting surface, and then aligning said drawer guide by tapping said attaching means with a hammer or the like.

2. A universal drawer guide mounting bracket as defined in claim 1, wherein said locking means comprises ribbing means, between said base means and said drawer guide attaching means, for creating a frictional force resisting movement of said drawer guide attaching means relative to said base means so that an external force greater than said frictional force must be applied to said drawer guide attaching means to move said attaching means relative to said base means.

3. A drawer guide mounting bracket as defined in claim 2, wherein said locking means further comprises means, projecting from said base means and engaging said guide attaching means, for placing said guide attaching means under compression as said base means is affixed to a mounting surface, said compression thereby resisting movement of said guide attaching means relative to said base means.

4. A universal drawer guide mounting bracket as defined in claim 1, further comprising means for increasing the resistance to movement between said base means and said drawer guide attaching means following final adjustment of said bracket.

5. A universal drawer guide mounting bracket as defined in claim 1, wherein said base means comprises:

a substantially flat base member; and a plurality of passage means, disposed within said member, for receiving a screw or other fastening device through said member, thereby allowing said base member to be attached to a flat mounting surface.

6. A universal drawer guide mounting bracket as defined in claim 1, wherein said drawer guide attaching means comprises a tongue member for positioning within the open end of a furniture-type drawer guide having a C-shaped cross section.

7. A universal drawer guide mount as defined in claim 1, wherein said drawer guide attaching means includes socket means for enclosing and receiving one end of a drawer guide.

8. The universal drawer guide mounting bracket as defined in claim 1, wherein said adjusting means comprises:

sliding foot means, formed with said guide attaching means, for moving said guide attaching means unidirectionally along said base means;

partially open channel means, formed on said base means, for retaining said sliding foot means against and permitting it to slide along said base means; and ribbing means, formed on the contacting surfaces of said channel means and said sliding foot means, for creating a frictional force resisting movement of said sliding foot means relative to said base means so that an external force greater than said frictional force must be applied to said guide attaching means to move said sliding foot relative to said base means.

9. A universal drawer guide mounting bracket as defined in claim 8, wherein said adjusting means further comprises adaptor plate means for allowing said guide attaching means to move bidirectionally with respect to said base means.

10. A universal drawer guide mounting bracket as defined in claim 9, wherein said adaptor plate means comprises:

a plate member positioned parallel to the surface upon which said guide mount is affixed;

further sliding foot means, formed on the side of said plate member closest to said base means, for allowing said adaptor plate means to move along said base means, said further sliding foot means slidably engaging said partially open channel means on said base means;

further partially open channel means, formed on the side of said plate member farthest from said mounting surface and oriented perpendicular to said further sliding foot means, for engaging said sliding foot formed on said guide attaching means and for allowing said sliding foot to move along said adaptor plate means, whereby said drawer guide attaching means is moved bidirectionally relative to said base means by moving said sliding foot means in said further open channel means and said further sliding foot means in said channel means; and further ribbing means, formed on the surfaces of said adaptor plate means contacting said channel means and said sliding foot means, for creating a frictional force resisting movement of said adaptor plate means and said guide attaching means relative to said base means so that an external force greater than said frictional force must be applied to said guide attaching means to move it relative to said base means.

11. A universal drawer guide mounting bracket as defined in claim 10, wherein said partially open channel means and said further partially open channel means each comprise two arm members integrally formed on and extending laterally across said base means and said plate member, respectively, said arm members oriented so as to project toward each other, said channels respectively exerting forces against said further sliding foot means and said sliding foot means which resist movement between said foot means and said channel means as said base means is affixed to a mounting surface.

12. A universal drawer guide mounting bracket as defined in claim 11, wherein said arm members comprise a pair of guide members extending angularly toward each other upwardly from said base means and said plate member, thereby forming, along with said base means and said plate member, channels having dovetail cross sections.

13. A universal drawer guide mounting bracket as defined in claim 11, wherein said arm members comprise a pair of L-shaped guide members extending upwardly from said base means and said plate member, thereby forming, along with said base means and said plate member, a channel having a T-shaped cross section.

14. A universal drawer guide mount as defined in claim 10, wherein said ribbing means and said further ribbing means comprise:

a single raised ridge disposed laterally across said channel means and said further channel means, respectively; and a plurality of ribs, disposed laterally across said sliding foot means and said further sliding foot means, respectively, said ribs engaging said ridge in said channel means and creating a frictional force resisting movement between said channel means and said further sliding foot means and between said further channel means and said sliding foot means, respectively.

15. A universal drawer guide mounting bracket as defined in claim 10, wherein said further partially open channel means is substantially identical in configuration to said partially open channel means, said further sliding foot means is substantially identical in configuration to said sliding foot means, and said sliding foot means and said further sliding foot means are substantially identical in cross section to said partially open channel means and said further partially open channel means, respectively.

16. A universal drawer guide mounting bracket providing adjustability in horizontal and vertical directions with respect to the surface to which said mounting bracket is attached, comprising:

base means for attaching said bracket to a mounting surface;

drawer guide attaching means for connecting one end of said mounting bracket to a furniture-type drawer guide;

adjusting means, forming integral portions of said base means and said drawer guide attaching means, for allowing horizontal and vertical adjustment of said drawer guide attaching means relative to said base means and for resisting movement of said drawer guide attaching means relative to said base means once the proper position of said drawer guide has been established; and means forming part of said base means and said drawer guide attaching means for resiliently biasing said adjusting means into movement resisting engagement;

whereby said mounting bracket may be easily positioned, in inaccessible locations such as inside the rear of a cabinet by centrally locating said attaching means relative to said base means, securing a drawer guide onto said drawer guide attaching means, locating said bracket in position while holding said drawer guide, securing said mounting bracket to a mounting surface, and then aligning said drawer guide by tapping said attaching means with a hammer or the like.

17. A drawer guide mounting bracket as defined in claim 16, wherein said adjusting means comprises:

a plurality of intersecting ridges extending laterally and longitudinally across said base means;

a sliding foot formed on said guide attaching means, said foot including a plurality of ribs frictionally engaging said ridges on said base means; and means for forcing said sliding foot against said base means, said means for forcing along with said ridges and said ribs allowing said sliding foot to be moved relative to said base means only upon application of an external force to said sliding foot so that said sliding foot is locked against said base means after the removal of said external force.

18. A drawer guide mounting bracket as defined in claim 17, wherein said means for forcing said sliding foot against said base means comprises a pair of arm members, connected to said base means and overhanging said ribs on said base member, said sliding foot being tapered at its ends away from said base means and positioned under said arm members.

19. A drawer guide mounting bracket as defined in claim 17, wherein said means for forcing comprises:

an area in the center of said base means defining a first slot;

an area in the center of said sliding foot defining a second slot; and pin means, passing through said first slot in said base member and through said second slot in said sliding foot, for frictionally positioning said sliding foot against said base means, said positioning resisting movement of said sliding foot relative to said base means.

20. A universal drawer guide mounting bracket as defined in claim 16, wherein said drawer guide attaching means comprises a tongue member, generally rectangular in cross section for positioning within the open end of a furniture-type drawer guide having a C-shaped cross section.

21. A universal drawer guide mounting bracket as defined in claim 16, wherein said drawer guide attaching means includes socket means for enclosing and receiving one end of a drawer guide.

22. A drawer guide mounting bracket as defined in claims 1 or 16, wherein said mounting bracket is constructed of a easily-formable material such as dense polyethylene.

23. A drawer guide mounting bracket as defined in claims 1 or 16 wherein said drawer guide is constructed of steel.

24. A drawer guide mounting bracket as defined in claims 1 or 16 wherein said drawer guide is constructed of plastic.

* * * * *